US008506129B2

(12) United States Patent
Okada

(10) Patent No.: US 8,506,129 B2
(45) Date of Patent: Aug. 13, 2013

(54) LIGHTING UNIT

(75) Inventor: Hidetaka Okada, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 46 days.

(21) Appl. No.: 13/357,584

(22) Filed: Jan. 24, 2012

(65) Prior Publication Data

US 2012/0188774 A1 Jul. 26, 2012

(30) Foreign Application Priority Data

Jan. 24, 2011 (JP) ..... 2011-012298

(51) Int. Cl.
*F21V 7/00* (2006.01)

(52) U.S. Cl.
USPC .. 362/299; 362/296.01; 362/308; 362/311.02

(58) Field of Classification Search
USPC ..... 362/299, 311.02, 296.11, 308
See application file for complete search history.

(56) References Cited

U.S. PATENT DOCUMENTS

| | | | |
|---|---|---|---|
| 6,679,621 | B2 | 1/2004 | West |
| 7,059,731 | B2 | 6/2006 | Lee et al. |
| 7,322,729 | B2 | 1/2008 | Nagabuchi |

FOREIGN PATENT DOCUMENTS

| | | | |
|---|---|---|---|
| JP | 2003-317508 | | 11/2003 |
| JP | 4458359 | B2 | 4/2010 |

*Primary Examiner* — Evan Dzierzynski
(74) *Attorney, Agent, or Firm* — Kenealy Vaidya LLP

(57) ABSTRACT

A lighting unit can include an LED light source, and a lens body light exiting surface greater in width than in thickness. The lens body can include a first optical system, a second optical system, and a third optical system. The first optical system can include: a lens section; a first light incident surface; a first total reflection surface; and a second total reflection surface. The second optical system can include: a second light incident surface; a third total reflection surface; and a fourth total reflection surface. The third optical system can include a third light incident surface and a fifth total reflection surface. The optical systems can direct light emitted by the source at wide or narrow angles to exit the lens body substantially parallel to the optical axis. A space can be formed between the lens section and the first light incident surface.

10 Claims, 9 Drawing Sheets

LIGHTING UNIT

This application claims the priority benefit under 35 U.S.C. §119 of Japanese Patent Application No. 2011-012298 filed on Jan. 24, 2011, which is hereby incorporated in its entirety by reference.

TECHNICAL FIELD

The presently disclosed subject matter relates to a lighting unit, and more specifically, to a lighting unit including an LED light source and a plate-like lens body used in combination.

BACKGROUND ART

A lighting unit including an LED light source and a plate-like lens body used in combination has conventionally been suggested (see, for example, Japanese Patent No. 4458359 which is hereinafter called patent literature 1).

As shown in FIGS. 1A to 1C, a lighting unit 200 disclosed in Patent Literature 1 can include a plate-like lens body 210, and an LED light source 220 arranged to face the front surface of the lens body 210. The lens body 210 can have a first side surface 211 functioning as a light exiting surface having a substantially rectangular shape greater in width than in thickness, and a second side surface 212 opposite the first side surface 211.

In the lighting unit 200 of the aforementioned structure, the lens body 210 with an optical element for causing refraction or reflection can allow the first side surface 211 as a light exiting surface to form a linear light source for emitting linear light. However, arrangement of an optical axis AX1 of the lens body 210 and an optical axis AX2 of the LED light source 220 crossing each other at right angles (see FIG. 1B) can make the layout design of a lamp difficult.

Alternatively, a linear light source for emitting linear light may also be formed by placing the LED light source 220 to face a side surface of the lens body 210 and not the front surface of the lens body 210 as shown in FIG. 2.

In this structure, however, a thickness H of the lens body 210 should be increased in order to increase the area of a light incident surface with the intention of enhancing the efficiency of use of light emitted from the LED light source 220. This makes the lens body 210 have a greater thickness accordingly, making it difficult or impossible to realize weight saving of the lighting unit 200.

SUMMARY

The presently disclosed subject matter was devised in view of these and other problems and features and in association with the conventional art. According to an aspect of the presently disclosed subject matter, a lighting unit can utilize a lens body which is smaller in thickness and lighter in weight than a conventional lens body, and which can achieve efficiency of use of light comparable to or higher than efficiency achieved by the conventional lens body.

According to another aspect of the presently disclosed subject matter, a lighting unit can include an LED light source, and a lens body with a first side surface functioning as a light exiting surface having a substantially rectangular shape greater in width than in thickness, and a second side surface opposite the first side surface. The LED light source can be arranged to face the second side surface such that a ray of light emitted in a wide angle direction with respect to an optical axis of the LED light source travels toward the front and rear surfaces of the lens body, and that a ray of light emitted in a narrow angle direction with respect to the optical axis enters the lens body through the second side surface. The lens body can include a first optical system, a second optical system, and a third optical system. The first optical system can include: a lens section formed on the front and rear surfaces or on the front or rear surface of the lens body such that a ray of light traveling toward the front and rear surfaces or toward the front or rear surface of the lens body enters the lens body, the lens section collecting the ray of light such that the ray of light travels along the optical axis; a first light incident surface arranged in an optical path of the ray of light collected by the lens section, the first light incident surface causing the ray of light to enter the lens body again; a first total reflection surface arranged in an optical path of the ray of light having entered the lens body through the first light incident surface, the first total reflection surface causing the ray of light to reflect totally in a direction crossing the optical axis at substantially right angles; and a second total reflection surface arranged in an optical path of the reflected ray of light having reflected totally off the first total reflection surface, the second total reflection surface causing the reflected ray of light to reflect totally to exit as a ray of light substantially parallel to the optical axis through a central region of the first side surface functioning as the light exiting surface. The second optical system can include: a second light incident surface formed on the second side surface, the second light incident surface collecting a ray of light emitted in a narrow angle direction with respect to the optical axis such that the ray of light travels along the optical axis; a third total reflection surface arranged in an optical path of the ray of light collected by the second light incident surface and having entered the lens body, the third total reflection surface causing the ray of light to reflect totally and sideways with respect to the optical axis; and a fourth total reflection surface arranged in an optical path of the ray of light having reflected totally off the third total reflection surface, the fourth total reflection surface causing the ray of light to reflect totally to exit as a ray of light substantially parallel to the optical axis through an outermost region at an outermost part of the first side surface functioning as the light exiting surface. The third optical system can include a third light incident surface for causing a ray of light emitted from the LED light source in a wide angle direction with respect to the optical axis and in the direction of the width of the lens body to enter the lens body, and a fifth total reflection surface for causing the ray of light having entered the lens body through the third light incident surface to reflect totally to exit as a ray of light substantially parallel to the optical axis through an intermediate region between the central region and the outermost region of the first side surface functioning as the light exiting surface. An air layer (space) for causing the ray of light collected by the lens section to pass therethrough can be formed between the lens section and the first light incident surface.

Light that travels toward the front and rear surfaces of the lens body (rays of light that do not enter a conventional lens body, see FIG. 2) may be increased by reducing the thickness of the lens body. Even in this case, in accordance with the principles of the presently disclosed subject matter, the first optical system (lens section and others) can allow the light that travels toward the front and rear surfaces of the lens body to enter the lens body again, so that reduction of the efficiency of use of light to be caused by reducing the thickness of the lens body will not occur. To be specific, the lighting unit made in accordance with the principles of the presently disclosed subject matter can utilize the lens body which is smaller in thickness and lighter in weight than a conventional lens body, and which is capable of achieving efficiency of use of light comparable to or higher than efficiency achieved by the conventional lens body.

Also, in the lighting unit made in accordance with the principles of the presently disclosed subject matter, the lens body (each of the optical systems) can make it possible to form a linear light source for emitting linear light through the light exiting surface (central region, outermost region, and intermediate region).

Still further, in a lighting unit made in accordance the principles of the presently disclosed subject matter, the presence of the air layer between the lens section and the first light incident surface can allow the lens body to be still smaller in thickness and lighter in weight accordingly.

Additionally, a lighting unit in accordance with the disclosed subject matter can be capable of forming a linear light source for emitting a ray of light substantially parallel to the optical axis.

Further, in a lighting unit made in accordance with principles of the presently disclosed subject matter, controlling each of the optical elements (lens section, each of the light incident surfaces, each of the total reflection surfaces, and others) makes it possible to form a linear light source of a substantially uniform intensity.

Still further, in a lighting unit made in accordance with principles of the presently disclosed subject matter, use of the total reflection surfaces providing a reflectance of 100% allows further enhancement of the efficiency of use of light, compared to use of a reflection surface that is minor finished by aluminum vapor deposition and the like.

In addition, in a lighting unit made in accordance with principles of the presently disclosed subject matter, coincidence between the optical axis of the LED light source and the optical axis of the lens body makes it possible to easily form a layout.

The lighting unit as described above can be used as a linear light source unit with the light projected from the first side surface.

The lighting unit as described above can include a lens body unit including a plurality of the above-mentioned lens bodies to each of which the LED light source is provided, the lens bodies being arranged side by side so as to form a large linear light source unit. In this case, the lens body unit can be formed by integrally molding the lens body unit as a whole. Or alternatively, the lens body unit can be formed by arranging the plurality of lens bodies side by side and fixing them in place.

The lighting unit using a lens body which is smaller in thickness and lighter in weight than a conventional lens body can be provided to achieve efficiency of use of light comparable to or higher than efficiency achieved by the conventional lens body.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to exemplary lighting units of the presently disclosed subject matter with reference to the accompanying drawings in accordance with exemplary embodiments.

Figure 3:
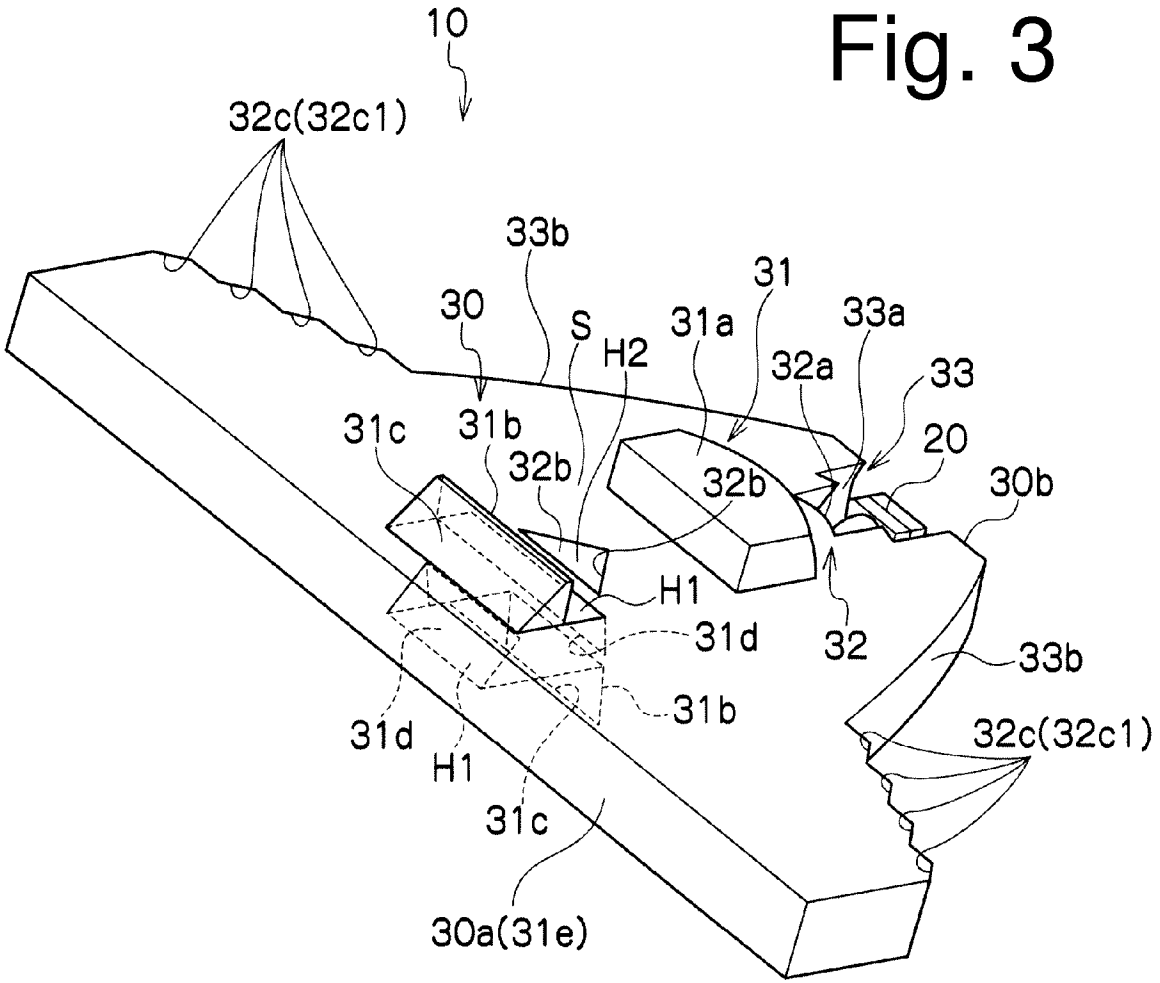
FIG. 3 is a perspective view of a lighting unit made in accordance with principles of the presently discloses subject matter, as viewed from the front.
Figure 4:
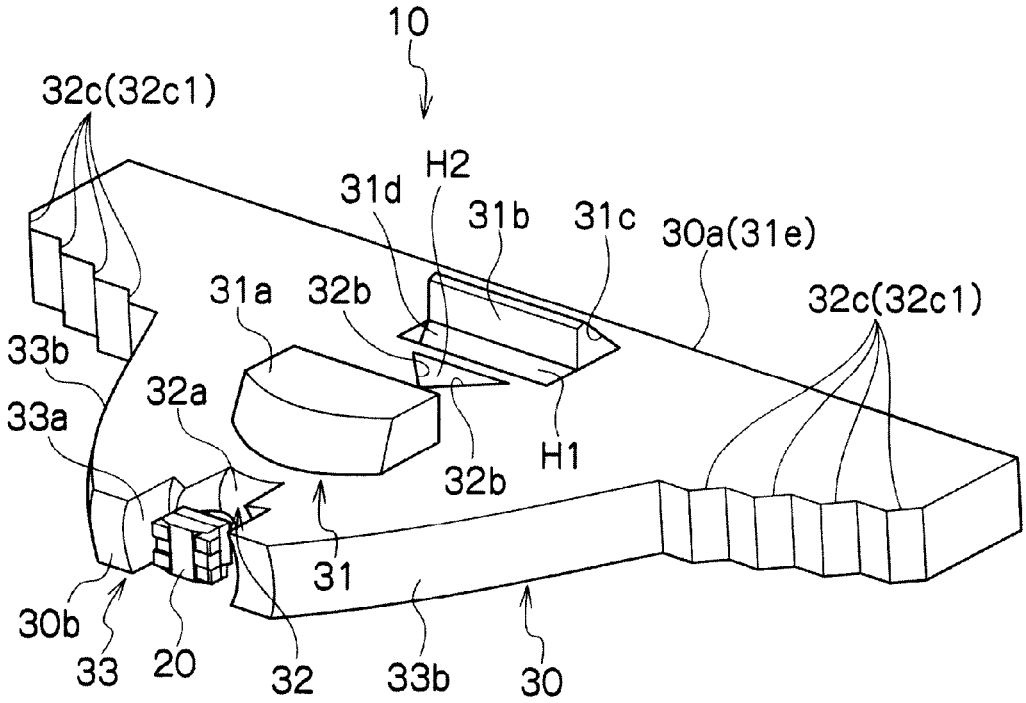
FIG. 4 is a perspective view of the lighting unit of FIG. 3 as viewed from the back.
Figure 5:
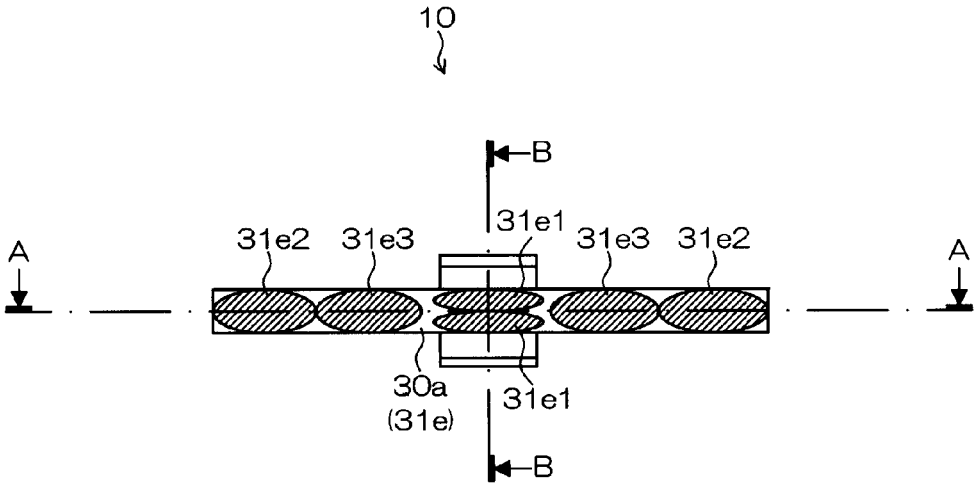
FIG. 5 is a front view of the lighting unit of FIG. 3.
Figure 6:
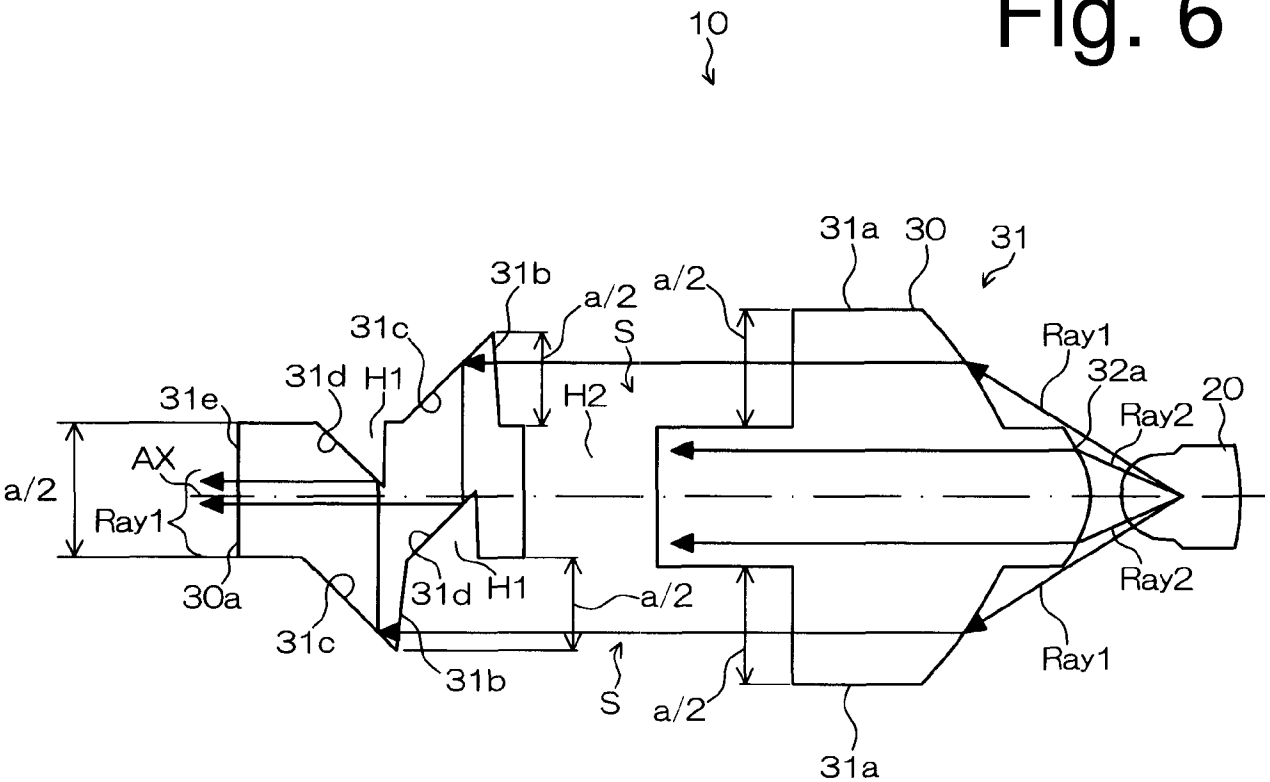
FIG. 6 is a cross-sectional view of the lighting unit taken along line B-B of FIG. 5.
Figure 7:
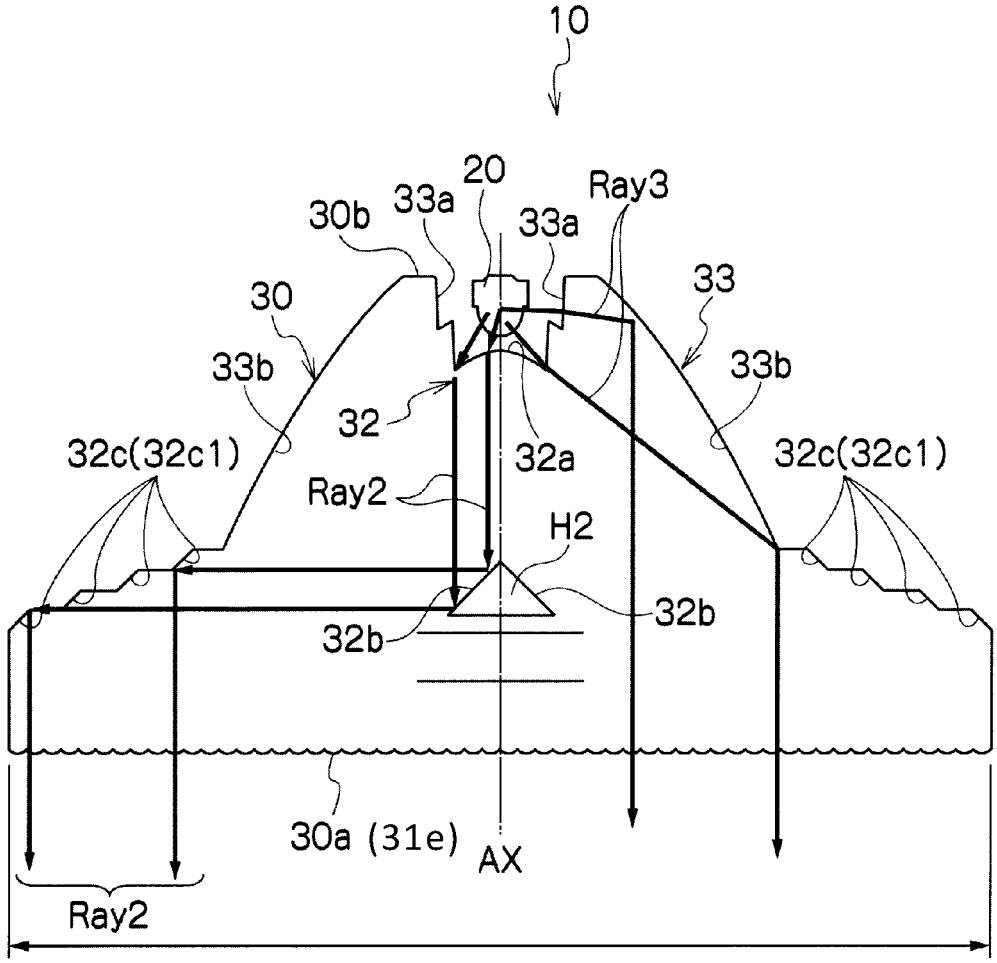
FIG. 7 is a cross-sectional view of the lighting unit taken along line A-A of FIG. 5.

FIG. 3 is a perspective view of a lighting unit 10 as viewed from the front. FIG. 4 is a perspective view of the lighting unit 10 as viewed from the back. FIG. 5 is a front view of the lighting unit 10. FIGS. 6 and 7 are cross-sectional views of the lighting unit 10 taken along lines B-B and A-A of FIG. 5, respectively.

The lighting unit 10 of the embodiment can be applied to a vehicle-mounted signal lamp and to a generally used illumination lamp. Examples of such a vehicle-mounted signal lamp include a rear position lamp, a stop lamp, a turn signal lamp, a daytime running lamp, and a position lamp. As shown in FIGS. 3, 4 and other figures, the lighting unit 10 can include an LED light source 20 and a lens body 30.

[LED Light Source 20]

The LED light source 20 can be an LED light source including at least one LED chip (a blue LED chip, for example) and a fluorescent substance (yellow fluorescent substance, for example). The LED light source 20 can emit white light (or quasi white light) containing light which is part of light emitted from the LED chip and which has passed through the fluorescent substance, and light from the fluorescent substance, generated by being excited by the light emitted from the LED chip.

As shown in FIG. 6, the LED light source 20 can be arranged to face a side surface of the lens body 30 such that rays of light Ray1 emitted in a wide angle direction with respect to an optical axis AX of the LED light source 20 can travel toward the front and rear surfaces of the lens body 30, and that rays of light Ray2 emitted in a narrow angle direction with respect to the optical axis AX can enter the lens body 30 through the side surface of the lens body 30.

[Lens Body 30]

As shown in FIGS. 3, 4, 6 and 7, the lens body 30 can be a lens body of a thickness of a, and have a plate form as a whole and made of a transparent resin (acrylic resin or polycarbonate resin, for example) or glass. The lens body 30 can include a first optical system 31, a second optical system 32, a third optical system 33, a first side surface 30*a* functioning as a light exiting surface 31*e* having a substantially rectangular shape greater in width than in thickness (see FIG. 5), a second side surface 30*b* opposite the first side surface 30*a*.

[First Optical System 31]

As shown in FIGS. 3 and 6, the first optical system 31 can include lens sections 31*a* (of a height of a/2), first light incident surfaces 31*b*, first total reflection surfaces 31*c*, and second total reflection surfaces 31*d*. The lens sections 31*a* can be formed on the front and rear surfaces of the lens body 30 such that the rays of light Ray1 traveling toward the front and rear surfaces of the lens body 30 enter the lens body 30. The lens sections 31*a* can collect the rays of light Ray1 such that the rays of light Ray1 can travel along the optical axis AX (in the embodiment, such that the rays of light Ray1 travel substantially parallel to the optical axis AX). The first light incident surfaces 31*b* can be arranged in optical paths of the rays of light Ray 1 collected by the lens sections 31*a*, and can cause these rays of light Ray 1 to enter the lens body 30 again. The first total reflection surfaces 31*c* can be arranged in optical paths of the rays of light Ray1 having entered the lens body 30 through the first light incident surfaces 31*b*, and can cause these rays of light Ray1 to reflect totally in a direction crossing the optical axis AX at substantially right angles (in the direction of the thickness of the lens body 30). The second total reflection surfaces 31*d* can be arranged in optical paths of the rays of light Ray1 having reflected totally off the first total reflection surfaces 31*c*, and can cause these rays of light Ray1 to reflect totally to exit as rays of light substantially parallel to the optical axis AX through a central region 31*e*1 (see FIG. 5) at substantially the center of the light exiting surface 31*e*. An air layer S (space) for causing the rays of light Ray1 collected by the lens sections 31*a* and traveling substantially parallel to the optical axis AX to pass therethrough can be formed between the lens sections 31*a* and the first light incident surfaces 31*b* (see FIGS. 3, 4 and 6).

The first light incident surfaces 31*b* can be lens surfaces (of a height of a/2) substantially perpendicular to a travel path of the rays of light Ray1 (so that the rays of light Ray1 are not reflected by the first light incident surfaces 31*b*.

In the present exemplary embodiment, recesses H1 can be formed on the rear surface (and the front surface) of the lens body 30 (see FIGS. 3 and 6), and parts of the recesses H1 (parts of surfaces forming the recesses H1) can function as the second total reflection surfaces 31*d*.

In the first optical system 31 of the aforementioned structure, the rays of light Ray1 which can be part of light emitted from the LED light source 20 and which are to travel toward the front and rear surfaces of the lens body 30 can be collected by the lens sections 31*a* to be converted to rays of light substantially parallel to the optical axis AX. Then, the rays of light Ray1 can pass through the air layer S (space) between the lens sections 31*a* and the first light incident surfaces 31*b*, and thereafter can enter the lens body 30 again through the first light incident surfaces 31*b* to travel inside the lens body 30. Then, the rays of light Ray1 can be caused to reflect totally twice by the first total reflection surfaces 31*c* and the second total reflection surfaces 31*d*, and exit as rays of light substantially parallel to the optical axis AX through the light exiting surface 31*e* (central region 31*e*1, see FIG. 5).

[Second Optical System 32]

As shown in FIGS. 4 and 7, the second optical system 32 can include a second light incident surface 32*a*, third total reflection surfaces 32*b*, and fourth total reflection surfaces 32*c*. The second light incident surface 32*a* can be formed on a side surface (second side surface 30*b*) of the lens body 30. The second light incident surface 32*a* can collect the rays of light Ray2 emitted in a narrow angle direction with respect to the optical axis AX (in the embodiment, rays of light having directional characteristics by which the rays of light are very likely to travel at an angle of 20 degrees with respect to the center of the LED light source 20) such that the rays of light Ray2 can travel along the optical axis AX (in the embodiment, such that the rays of light Ray2 travel substantially parallel to the optical axis AX). The third total reflection surfaces 32*b* can be arranged in optical paths of the rays of light Ray2 collected by the second light incident surface 32*a* and having entered the lens body 30, and cause these rays of light Ray2 to reflect totally and sideways with respect to the optical axis AX. The fourth total reflection surfaces 32*c* can be arranged in optical paths of the rays of light Ray2 having reflected totally off the third total reflection surfaces 32*b*, and cause these rays of light Ray2 to reflect totally to exit as rays of light substantially parallel to the optical axis AX through outermost regions 31*e*2 (see FIG. 5) at outermost parts of the light exiting surface 31*e*.

The fourth total reflection surfaces 32*c* can each include a plurality of separate total reflection surfaces 32*c*1 in a step-like pattern formed separately in the direction of the width of the lens body 30.

In the present exemplary embodiment, a through hole H2 penetrating the lens body 30 from the front surface to the rear surface thereof can be formed ahead of the second light incident surface 32*a* (see FIGS. 4 and 7). The through hole H2 (part of a surface forming the through hole H2 and, in the present exemplary embodiment, this part corresponds to surfaces tilted at an angle of 45 degrees from the optical axis AX) can function as the third total reflection surfaces 32*b*.

In the second optical system 32 of the aforementioned structure, the rays of light Ray2 emitted from the LED light source 20 in a narrow angle direction with respect to the optical axis AX can be collected by the second light incident surface 32*a* to be converted to rays of light substantially parallel to the optical axis AX, and then can travel inside the lens body 30. Then, the rays of light Ray2 can be caused to reflect totally twice by the third total reflection surfaces 32*b* and the fourth total reflection surfaces 32*c* (plurality of separate total reflection surfaces 32*c*1), and can exit as rays of light substantially parallel to the optical axis AX through the light exiting surface 31*e* (outermost regions 31*e*2, see FIG. 5).

[Third Optical System 33]

As shown in FIGS. 4 and 7, the third optical system 33 can include a third light incident surface 33*a*, fifth total reflection surfaces 33*b*, and others. The third light incident surface 33*a* can cause rays of light Ray3 emitted from the LED light source 20 in a wide angle direction with respect to the optical axis AX and in the direction of the width of the lens body 30 to enter the lens body 30. The fifth total reflection surfaces 33*b* can cause the rays of light Ray3 having entered the lens body 30 through the third light incident surface 33*a* to reflect totally to exit as rays of light substantially parallel to the optical axis AX through intermediate regions 31*e*3 (see FIG. 5) of the light exiting surface 31*e* between the central region 31*e*1 and the outermost regions 31*e*2.

As an example, the third light incident surface 33*a* can be a lens surface in the form of an upright wall (in the form of a cylinder) extending from the periphery of the second light incident surface 32*a* toward the LED light source 20.

As an example, the fifth total reflection surfaces 33*b* can be total reflection surfaces belonging to paraboloids of revolution and the focal point of which is set at an intersecting point (not shown) of extended lines of rays of light in a group (rays of light Ray3) having entered the lens body 30 after being refracted off the third light incident surface 33*a*. In the present exemplary embodiment, side surfaces of the lens body 30 can function as the fifth total reflection surfaces 33*b*.

In the third optical system 33 of the aforementioned structure, the rays of light Ray3 emitted from the LED light source 20 in a wide angle direction with respect to the optical axis AX and in the direction of the width of the lens body 30 can enter the lens body 30 through the third light incident surface 33*a*, and then travel inside the lens body 30. Then, the rays of light Ray3 can be caused to reflect totally by the fifth total reflection surfaces 33*b*, and exit as rays of light substantially parallel to the optical axis AX through the light exiting surface 31*e* (intermediate regions 31*e*3, see FIG. 5).

As described above, in the aforementioned exemplary embodiment, the lens body 30 (each of the optical systems 31 to 33) makes it possible to form a linear light source for emitting linear light (see FIG. 5) through the light exiting surface 31*e* (central region 31*e*1, outermost regions 31*e*2, and intermediate regions 31*e*3).

Figure 1A:
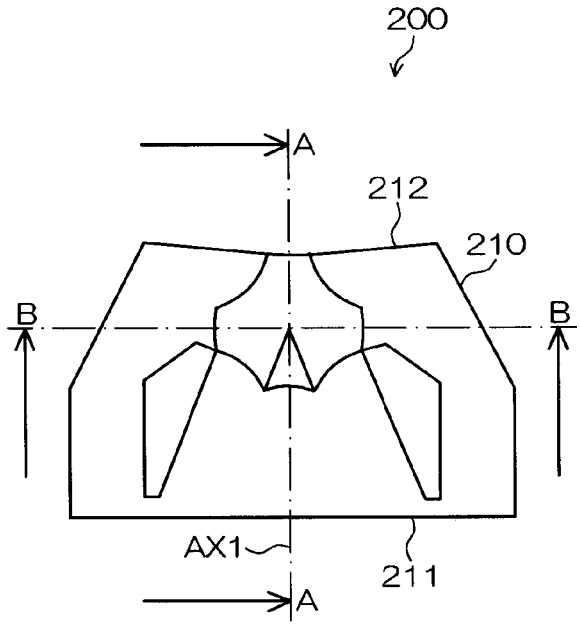
Fig. 1A Conventional Art
FIGS. 1A, 1B, and 1C are a top view of a conventional lighting unit, a cross-sectional view taken along line A-A in FIG. 1A, and a cross-sectional view taken along line B-B in FIG. 1A.
Figure 1B:
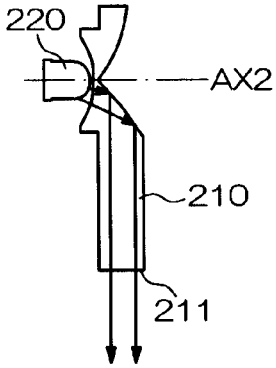
Fig. 1B Conventional Art
Figure 1C:
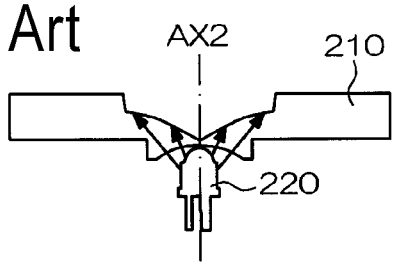
Fig. 1C Conventional Art
Figure 2:
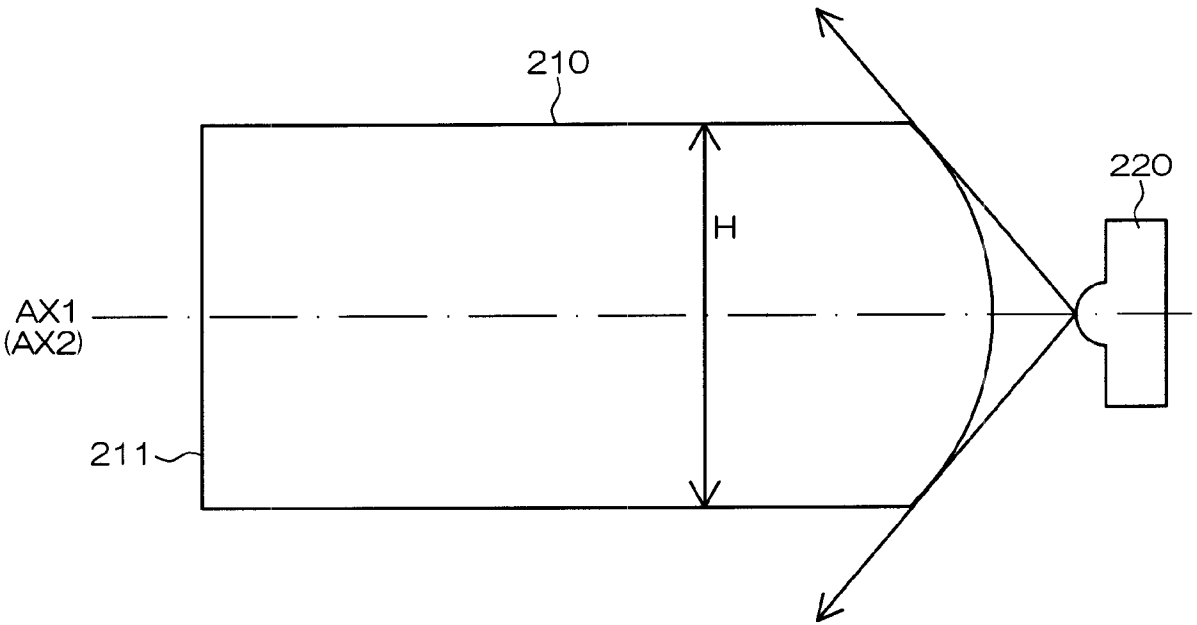
Fig. 2 Conventional Art
FIG. 2 is a schematic view illustrating another conventional lighting unit.

Further, the rays of light Ray1 to travel toward the front and rear surfaces of the lens body 30 (rays of light not to enter a conventional lens body, see FIG. 2) may be increased by reducing the thickness of the lens body 30. Even in this case, in the aforementioned exemplary embodiment, the first optical system 31 (lens sections 31*a* and others) can allow these rays of light Ray1 to travel toward the front and rear surfaces of the lens body 30 to enter the lens body 30 again, so that reduction of the efficiency of use of light to be caused by reducing the thickness of the lens body 30 will not occur. To be specific, the present exemplary embodiment can provide the lighting unit 10 using the lens body 30 which is smaller in thickness and lighter in weight than a conventional lens body, and which is capable of achieving efficiency of use of light comparable to or higher than efficiency achieved by the conventional lens body.

Further, in the aforementioned exemplary embodiment, the presence of the air layer S (space) between the lens sections 31*a* and the first light incident surfaces 31*b* (see FIGS. 3 and 6) allows the lens body 30 to be still smaller in thickness and lighter in weight accordingly.

Also, the aforementioned exemplary embodiment can form a linear light source for emitting the rays of light Ray1, Ray2 and Ray3 (see FIGS. 6 and 7) substantially parallel to the optical axis AX.

Further, in the aforementioned exemplary embodiment, controlling each of the optical elements (the lens sections 31*a*, each of the light incident surfaces 31*b*, 32*a* and 33*a*, each of the total reflection surfaces 31*c*, 31*d*, 32*b*, 32*c* and 33*b*, and others) makes it possible to form a linear light source of a substantially uniform intensity.

Also, in the aforementioned exemplary embodiment, use of the total reflection surfaces providing a reflectance of 100% (first to fifth total reflection surfaces 31*c*, 31*d*, 32*b*, 32*c* and 33*b*) allows further enhancement of the efficiency of use of light, compared to use of a reflection surface mirror finished by aluminum vapor deposition and the like (providing a reflectance of 90%, for example).

In addition, in the aforementioned exemplary embodiment, coincidence between the optical axis AX of the LED light source 20 and the optical axis of the lens body 30 makes it possible to form a layout easily.

A modification will be described next.

In the aforementioned exemplary embodiment, the optical elements (including lens sections 31*a*, light incident surfaces 31*b*, 32*a* and 33*a*, total reflection surfaces 31*c*, 31*d*, 32*b*, 32*c* and 33*b*, and others) can be formed on the front and rear surfaces of the lens body 30, to which the presently disclosed subject matter is not intended to be limited.

Figure 8:
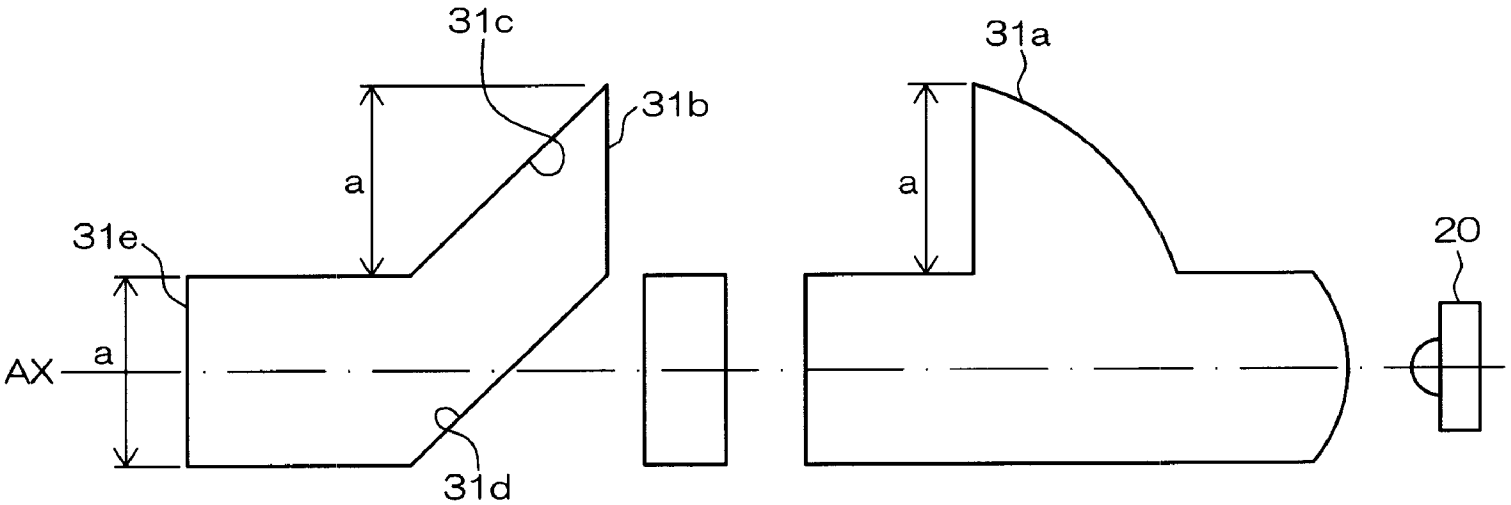
FIG. 8 is a cross-sectional view of a modification of a lighting unit in accordance with principles of the presently discloses subject matter.

By way of example, optical elements including lens section 31*a*, light incident surface 31*b*, total reflection surfaces 31*c* and 31*d*, and others may be provided only on either the front surface or the rear surface of the lens body 30 as shown in FIG. 8. In this exemplary embodiment, the heights of the lens section 31*a* and the first light incident surface 31*b* be the same as the thickness a of the lens body 30.

This modification can achieve the same effect as that achieved by the aforementioned exemplary embodiment.

In addition, the light exiting surface 31*e* may be given a lens cut formed thereon. The light exiting surface 31*e* may be flat, and a lens section given a lens cut may be provided ahead of the light exiting surface 31*e*. In either case, the lens cut can control the rays of light Ray1, Ray 2 and Ray3 substantially parallel to the optical axis AX, so that light can be distributed in accordance with a target light strength distribution.

Figure 9:
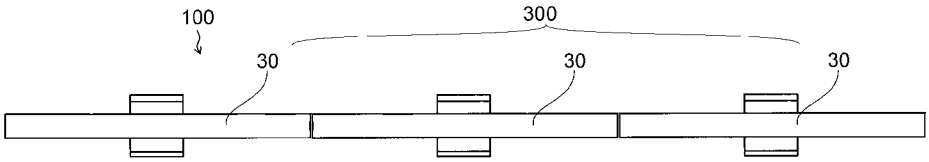
FIG. 9 is a front view of a lighting unit serving as a large linear light source unit.

FIG. 9 shows another modification of a lighting unit serving as a large linear light source unit. As shown, a plurality of the lens bodies 30 can be arranged side by side so as to form a lens body unit 300 for a large linear light source unit 100. This linear light source unit 100 can be formed by integrally molding a single lens body unit 300 as a unit or fixing a plurality of lens bodies 30 in place while arranging them side by side. Further, although not illustrated, a plurality of the large linear light source units 100 can be arranged in a vertical direction so that a large rectangular light source unit can be formed. The large linear light source unit 100 is applicable to an automobile signal lamp such as a tail lamp, a stop lamp, a turn signal lamp, a daytime running lamp, and a position lamp.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting unit comprising:

an LED light source, and a lens body with a first side surface defining a light exiting surface having a substantially rectangular shape greater in width than in thickness, a second side surface opposite the first side surface, a front surface connected to the first side surface and the second side surface, and a rear surface connected to the first side surface and the second side surface, wherein:

the LED light source faces the second side surface such that a ray of light emitted in a wide angle direction with respect to an optical axis of the LED light source travels toward the front and rear surfaces of the lens body, and such that a first ray of light emitted in a first narrow angle direction with respect to the optical axis enters the lens body through the second side surface;

the lens body includes a first optical system, a second optical system, and a third optical system;

the first optical system includes:

a lens section formed on at least one of the front surface and rear surface of the lens body such that a second ray of light traveling toward the at least one of the front and rear surfaces enters the lens body, the lens section configured to collect the second ray of light such that the second ray of light travels substantially parallel to the optical axis;

a first light incident surface separated from the lens section by a space and arranged in an optical path of the second ray of light collected by the lens section such that the second ray of light collected by the lens section passes to the first incident surface through the space, the first light incident surface configured to cause the second ray of light to enter the lens body again;

a first total reflection surface arranged in an optical path of the second ray of light having entered the lens body through the first light incident surface, the first total reflection surface configured to cause the second ray of light to reflect totally in a direction crossing the optical axis at substantially a right angle; and a second total reflection surface arranged in an optical path of the reflected second ray of light having reflected totally off the first total reflection surface, the second total reflection surface configured to cause the reflected second ray of light to reflect totally to exit as a ray of light substantially parallel to the optical axis through a central region of the first side surface;

the second optical system includes:

a second light incident surface formed on the second side surface, the second light incident surface configured to collect the first ray of light emitted in a narrow angle direction with respect to the optical axis such that the first ray of light travels substantially parallel to the optical axis;

a third total reflection surface arranged in an optical path of the first ray of light collected by the second light incident surface and having entered the lens body, the third total reflection surface configured to cause the first ray of light to reflect totally and sideways with respect to the optical axis; and a fourth total reflection surface arranged in an optical path of the first ray of light having reflected totally off the third total reflection surface, the fourth total reflection surface configured to cause the first ray of light to reflect totally to exit as a ray of light substantially parallel to the optical axis through an outermost region at an outermost part of the first side surface;

the third optical system includes:

a third light incident surface configured to cause a third ray of light emitted from the LED light source in a wide angle direction with respect to the optical axis and in the direction of the width of the lens body to enter the lens body; and a fifth total reflection surface configured to cause the third ray of light having entered the lens body through the third light incident surface to reflect totally to exit as a ray of light substantially parallel to the optical axis through an intermediate region between the central region and the outermost region of the first side surface functioning as the light exiting surface.

2. The lighting unit according to claim 1, configured as a linear light source unit with the light projected from the first side surface.

3. The lighting unit according to claim 1, further comprising a lens body unit including a plurality of the lens bodies to each of which the LED light source is provided, the lens bodies being arranged side by side so as to form a large linear light source unit.

4. The lighting unit according to claim 3, wherein the lens body unit is integrally molded such that the lens body unit is a whole unitary structure.

5. The lighting unit according to claim 3, wherein the lens body unit includes the plurality of lens bodies located side by side and fixed in place.

6. The lighting unit according to claim 1, wherein the lens body consists of a single piece of transparent plastic.

7. The lighting unit according to claim 1, wherein the front surface and rear surface are substantially flat surfaces, and the lens section and first light incident surface extend away from at least one of the front surface and rear surface of the lens body.

8. The lighting unit according to claim 1, wherein the front surface and rear surface are substantially flat surfaces, and the lens section and first light incident surface extend away from both the front surface and rear surface of the lens body.

9. The lighting unit according to claim 1, wherein the third total reflection surface includes a surface defined by an aperture extending through the lens body from the front surface to the rear surface.

10. The lighting unit according to claim 9, wherein the aperture is triangular in shape as viewed from above the front surface of the lens body.

* * * * *